United States Patent [19]

Tanaka

[11] Patent Number: 4,564,341

[45] Date of Patent: Jan. 14, 1986

[54] FUEL INJECTION PUMP FOR AN INTERNAL COMBUSTION ENGINE

[75] Inventor: Toshiaki Tanaka, Chigasaki, Japan

[73] Assignee: Nissan Motor Company, Limited, Yokohama, Japan

[21] Appl. No.: 606,266

[22] Filed: May 2, 1984

[30] Foreign Application Priority Data

May 4, 1983 [JP] Japan ..... 58-78804

[51] Int. Cl.[4] ..... F04B 19/02

[52] U.S. Cl. ..... 417/462; 417/221; 123/300; 123/450

[58] Field of Search ..... 417/221, 462; 123/299, 123/300, 450

[56] References Cited

U.S. PATENT DOCUMENTS

| | | | |
|---|---|---|---|
| 2,278,245 | 3/1942 | Colell | 417/251 |
| 2,674,236 | 4/1954 | Humber | 417/462 |
| 2,946,292 | 7/1960 | Chmielecki | 417/462 X |
| 3,759,239 | 9/1973 | Regneault et al. | 123/299 X |
| 3,827,419 | 8/1974 | Isomura | 123/300 |
| 4,140,095 | 2/1979 | Mowbray | 123/299 X |
| 4,173,959 | 11/1979 | Sosnowski et al. | 417/462 X |
| 4,242,059 | 12/1980 | Mowbray | 417/462 |
| 4,294,210 | 10/1981 | Bassoli et al. | 123/300 |

FOREIGN PATENT DOCUMENTS

| | | | |
|---|---|---|---|
| 73968 | 3/1983 | European Pat. Off. | 123/450 |
| 1042962 | 11/1958 | Fed. Rep. of Germany | 123/300 |
| 1053245 | 3/1959 | Fed. Rep. of Germany | 417/462 |
| 1092727 | 11/1960 | Fed. Rep. of Germany | 417/462 |
| 2717323 | 11/1977 | Fed. Rep. of Germany | 417/462 |
| 2719990 | 11/1977 | Fed. Rep. of Germany | 417/462 |
| 784589 | 10/1975 | United Kingdom | 417/462 |
| 2086994 | 5/1982 | United Kingdom | 417/462 X |
| 2102890 | 2/1983 | United Kingdom | 123/450 |
| 2103728 | 2/1983 | United Kingdom | 123/450 |

*Primary Examiner*—William L. Freeh
*Assistant Examiner*—Paul F. Neils
*Attorney, Agent, or Firm*—Schwartz, Jeffery, Schwaab, Mack, Blumenthal & Evans

[57] ABSTRACT

A member is formed with first and second cam protrusions. First and second movable plungers define a common pumping chamber, the volume of which varies in accordance with the position of each of the plungers. The plungers alternately engage the cam protrusions and are reciprocated thereby in synchronism with rotation of an engine crankshaft. Fuel is supplied to the pumping chamber as the pumping chamber expands. The fuel is directed out of the pumping chamber toward an engine combustion chamber to effect a fuel injection stroke as the pumping chamber contracts. The timing of engagement of one of the plungers with one of the cam protrusions and the timing of engagement of the other plunger with the other cam protrusion are offset by a preset angular interval with respect to rotation of the crankshaft, the interval being chosen so that the rate of fuel injection during an initial stage of the fuel injection stroke is relatively small.

7 Claims, 4 Drawing Figures

FUEL INJECTION PUMP FOR AN INTERNAL COMBUSTION ENGINE

BACKGROUND OF THE INVENTION

This invention relates to a fuel injection pump for an internal combustion engine, such as a diesel engine.

Diesel engines are supplied with fuel by means of fuel injection pumps. These injection pumps force fuel into the engine combustion chambers periodically with respect to rotation of the engine crankshafts.

The variation of the rate of fuel injection with the rotational angle of the crankshaft during each fuel injection stroke affects fuel combustion characteristics. In particular, the fuel combustion characteristics sensitively depend on the amount of fuel injected during the initial stage of each fuel injection stroke relative to the amount of fuel injected during the rest of the stroke. From the standpoint of reducing fuel combustion shocks, engine vibration and noise, and of reducing harmful engine emissions, it is desirable to decrease the proportion of fuel injected during the initial stage of each fuel injection stroke.

SUMMARY OF THE INVENTION

It is an object of this invention to provide a fuel injection pump for an internal combustion engine which suppresses fuel combustion shocks and engine vibration and noise.

In accordance with this invention, a member is formed with first and second cam protrusions. First and second movable plungers define a common pumping chamber, the volume of which varies in accordance with the position of each of the plungers. The plungers alternately engage the cam protrusions and are reciprocated thereby in synchronism with rotation of an engine crankshaft. Fuel is supplied to the pumping chamber as the pumping chamber expands. The fuel is directed out of the pumping chamber toward an engine combustion chamber as the pumping chamber contracts. The timing of engagement of one of the plungers with one of the cam protrusions and the timing of engagement of the other plunger with the other cam protrusion are offset by a preset angular interval with respect to rotation of the crankshaft.

DESCRIPTION OF THE PREFERRED EMBODIMENT

Figure 1:
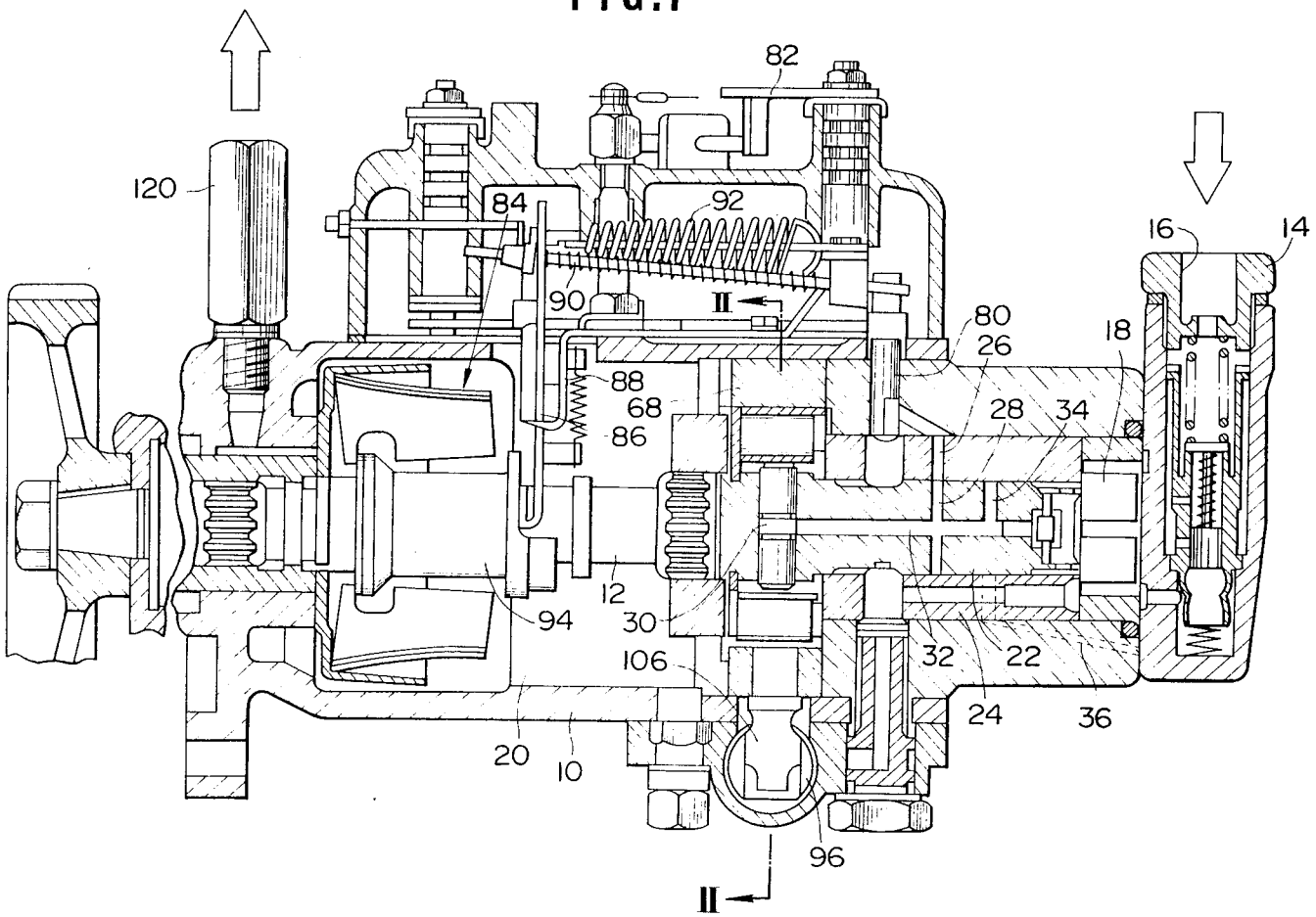
FIG. 1 is a longitudinal section view of a fuel injection pump according to this invention.

With reference to FIG. 1, a distribution-type fuel injection pump for a diesel engine includes a housing 10 and a drive shaft 12 rotatably extending into the housing 10. A section of the drive shaft 12 protruding from the housing 10 is coupled to the engine crankshaft in a well-known way so as to rotate about its axis at half the speed of rotation of the crankshaft.

An inlet connector 14 attached to the housing 10 defines a fuel inlet 16, to which fuel is supplied from a fuel tank (not shown) by a pre-supply pump (not shown). A vane-type rotary transfer pump 18 disposed within the housing 10 is coupled to the drive shaft 12 to be driven by the engine. The transfer pump 18 drives fuel from the inlet 16 into a fuel reservoir or chamber 20 defined within the housing 10.

A cylindrical fuel-distributing rotor 22 disposed within the housing 10 is coaxially connected to the drive shaft 12 to rotate about its axis in conformity with rotation of the drive shaft 12. The rotor 22 rotatably and coaxially extends through a sleeve or barrel 24 secured to the housing 10.

A fuel intake port 26 formed in the walls of the housing 10 and the barrel 24 extends from the outlet of the transfer pump 18 to the interior of the barrel 24 so that fuel can be transmitted to the interior of the barrel 24. The rotor 22 has a set of radial fuel intake passages 28, the number of which equals that of the engine combustion chambers. The outer ends of the intake passages 28 opening onto the periphery of the rotor 22, are spaced circumferentially with respect to the rotor 22, at equal angular intervals and are in the same axial position as the inner end of the intake port 26. As the rotor 22 rotates, the intake port 26 moves into and out of register or communication with each of the intake passages 28 sequentially. The rotor 22 is provided with a high-pressure or pumping chamber 30. A axial passage 32 formed in the rotor 22 extends from the inner ends of the intake passages 28 to the pumping chamber 30. When the intake port 26 communicates with one of the intake passages 28, fuel can be directed toward the pumping chamber 30 via the intake port 26, the intake passages 28, and the axial passage 32.

The rotor 22 has a radial fuel discharge passage 34, the inner end of which opens into an extension of the axial passage 32 and the outer end of which opens onto the periphery of the rotor 22 inside the barrel 24. The walls of the barrel 24 and the housing 10 define a set of fuel delivery ports 36 extending from the inner surface of the barrel 24 to the outer surface of the housing 10. The number of the delivery ports 36 equals that of the engine combustion chambers. Note that only one of the delivery ports 36 is diagrammatically shown in phantom lines in FIG. 1. The inner ends of the delivery ports 36 are spaced circumferentially with respect to the barrel 24 at equal angular intervals and are in the same axial position as the discharge passage 34. As the rotor 22 rotates, the discharge passage 34 moves into and out of register or communication with each of the delivery ports 36 sequentially. When the discharge passage 34 comes into communication with the delivery ports 36, fuel can be directed from the pumping chamber 30 toward the delivery ports 36 via the axial passage 32 and the discharge passage 34. Each of the delivery ports 36 leads to a fuel injection valve or nozzle (not shown) which is designed to inject fuel into the associated engine combustion chamber.

Figure 2:
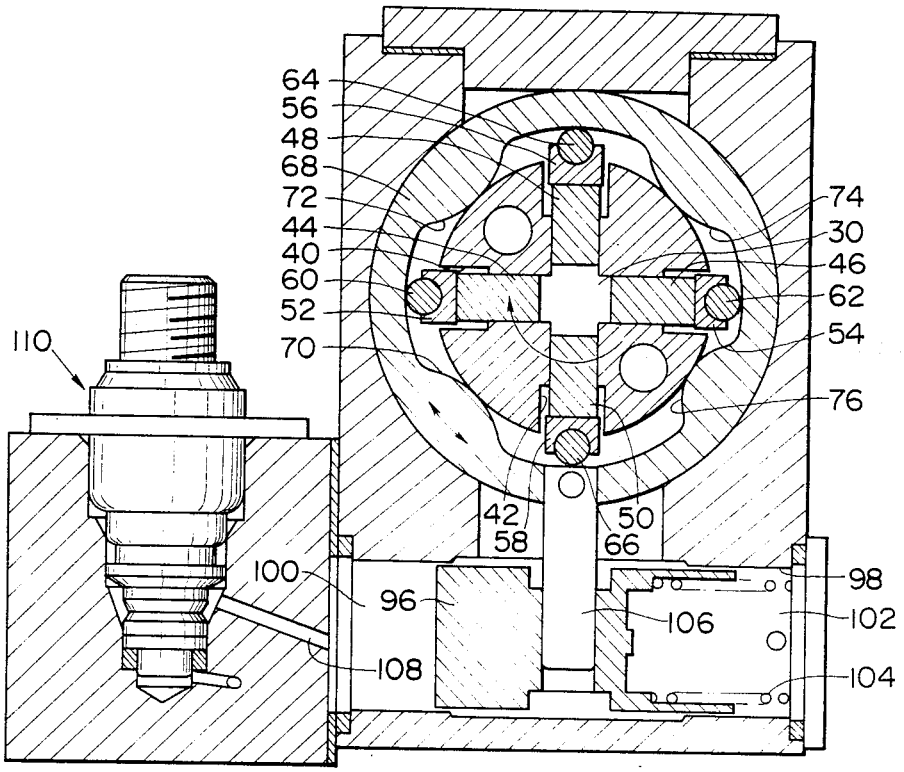
FIG. 2 is a cross-sectional view taken along the line II—II of FIG. 1.

As shown in FIG. 2, the rotor 22 is formed with a pair of interconnected diametrical bores 40 and 42 extending perpendicular to each other. A pair of spaced plungers 44 and 46 are slideably disposed in opposite ends of the first bore 40. The plungers 44 and 46 extend radially with respect to the rotor 22. Another pair of spaced plungers 48 and 50 are slideably disposed in opposite ends of the second bore 42. The plungers 48 and 50 extend radially with respect to the rotor 22. The inner ends of the plungers 44–50 cooperate to define the pumping chamber 30 in conjunction with the bores 40 and 42. The number of the plungers 44–50 equals that of the engine combustion chambers.

Roller shoes 52, 54, 56, and 58 are fixed to the outer ends of the plungers 44–50 respectively. A set of rollers 60, 62, 64, and 66 extending axially with respect to the rotor 22 are rotatably retained by the shoes 52–58, respectively.

A cam ring 68 disposed within and supported on the housing 10 concentrically encircles the rotor 22. The part of each of the rollers 60–66 exposed by the shoes 52–58 can engage the inner surface of the cam ring 68 provided with circumferentially spaced cam protrusions 70, 72, 74, and 76. The number of the cam protrusions 70–76 equals that of the plungers 44–50.

As the rotor 22 rotates, the rollers 60–66 rotate about the axis of the rotor 22. Rotation of the rotor 22 exerts centrifugal forces on the rollers 60–66 which can urge the rollers 60–66 into contact with the cam ring 68. As the rotor 22 rotates, the rollers 60–66 rotate also about their own axes, provided that the rollers 60–66 remain in contact with the cam ring 68. As the rollers 60–66 "ascend" the cam protrusions 70–76 in accordance with rotation of the rotor 22, the plungers 44–50 are displaced radially inward, thereby contracting the pumping chamber 30. As the rollers 60–66 "descend" the cam protrusions 70–76 in accordance with rotation of the rotor 22, the plungers 44–50 are displaced radially outward, thereby expanding the pumping chamber 30.

The angular relationships between the cam protrusions 70–76 and the plungers 44–50 and between the intake port 26 and the intake passages 28 are tuned so that as the pumping chamber 30 expands in accordance with rotation of the rotor 22, the intake port 26 remains in communication with one of the intake passages 28 and hence fuel is directed toward the pumping chamber 30 via the intake port 26, the intake passage 28, and the axial passage 32. In this way, a fuel intake stroke is performed. Similarly, as the pumping chamber 30 contracts in accordance with rotation of the rotor 22, the discharge passage 34 remains in communication with one of the delivery ports 36 so that fuel is forced out of the pumping chamber 30 toward the delivery port 36 via the axial passage 32 and the discharge passage 34. In this case, the pressurized fuel is driven through the delivery port 36 to the associated fuel injection valve before being injected into the associated engine combustion chamber via the injection valve. In this way, a fuel injection stroke is performed. Since the angular position of the rotor 22 determines which of the delivery ports 36 communicates with the discharge passage 34, fuel is distributed to the engine combustion chambers in accordance with rotation of the rotor 22.

A fuel metering valve 80 disposed within and supported on the housing 10 determines the effective cross-sectional area of the fuel intake port 26, that is, the rate of fuel supply to the pumping chamber 30. Since the rate of fuel injection into the engine corresponds to the rate of fuel supply to the pumping chamber 30, the metering valve 80 determines the rate of fuel injection into the engine. The metering valve 80 has a rotatable valve shaft, the angular position of which determines the effective cross-sectional area of the fuel intake port 26, that is, the rate of fuel injection into the engine.

Since fuel is not expansile, the amount of fuel admitted into the pumping chamber 30 during each fuel intake stroke determines the maximum volume of the pumping chamber 30 during that fuel intake stroke, although rotation of the rotor 22 exerts centrifugal forces on the plungers 40–50 which urge expansion of the pumping chamber 30. In this way, the outermost position which the rollers 60–66 can reach depends on the amount of fuel admitted into the pumping chamber 30 during each fuel intake stroke. Accordingly, radial displacement or stroke of the plungers 44–50 starting from the position opposite the peaks of the cam protrusions 70–76 depends on the rate of fuel supply to the combustion chamber 30. As the maximum radial stroke of the plungers 44–50 decreases, the angular interval for which the rollers 60–66 are separated from the inner surface of the cam ring 68 increases. In other words, as the rate of fuel injection decreases, the total area of the surfaces of the cam protrusions 70–76 effecting fuel intake and injection also decreases.

A control lever 82 linked to an accelerator pedal (not shown) is pivotally attached to the housing 10. The angle of the control lever 82 depends on the degree of depression of the accelerator pedal reflecting the engine load. A centrifugal governor 84 disposed within the housing 10 is associated with the drive shaft 12 to respond to the rotational speed of the drive shaft 12, that is, the engine speed. The control lever 82 and the governor 84 have driving connections with the metering valve 80 so that the rate of fuel supply to the engine is controlled in response to the engine speed and the engine load.

A control rod 86 is pivotably supported on a fulcrum 88 mounted on the housing 10. One end of the control rod 86 is linked to one end of the valve shaft of the metering valve 80 via a metering bar 90. As the control rod 86 pivots, the valve shaft of the metering valve 80 pivots accordingly. The end of the control rod 86 is also connected to the control lever 82 via a governor spring 92, so that the position of the control rod 86 depends on the angle of the control lever 82. The other end of the control rod 86 engages an axially movable governor sleeve 94 of the governor 84 coaxially surrounding the drive shaft 12. The position of the control rod 86 depends on the position of the governor sleeve 94. The governor sleeve 94 moves in accordance with the rotational speed of the drive shaft 12, that is, the engine speed due to the action of governor flyweights (not labelled). Since the position of the valve shaft of the metering valve 80 depends on the position of the control rod 86 which varies as a function of the engine load and the engine speed, the rate of fuel supply to the engine depends on the engine load and the engine speed.

The cam ring 68 is pivotable relative to the housing 10 in both circumferential directions, that is, in the directions equal to and opposite the direction of rotation of the rotor 22. Pivoting the cam ring 68 in the direction opposite that of rotation of the rotor 22 causes an advance of timing, in regard to the rotational angle of the rotor 22 and thus to the crank angle of the engine, at which the rollers 60–66 encounter the cam protrusions 70–76. Such a pivotal displacement of the cam ring 68, thus, results in an advance of timing of fuel injection. Pivoting the cam ring 68 in the direction of rotation of the rotor 22 causes a retardation of timing, in regard to rotational angle of the rotor 22 and thus to crank angle of the engine, at which the rollers 60–66 encounter the cam protrusions 70–76. Such a pivotal displacement of the cam ring 68, thus, results in a retardation of timing of fuel injection. In this way, the angular position of the cam ring 68 relative to the housing 10 determines the timing of fuel injection, in regard to crank angle of the engine.

A timer piston 96 is slidably disposed in a blind bore 98 defined in the walls of the housing 10 directly below the cam ring 68. The axis of the bore 98 lies perpendicular to the axis of the cam ring 68 so that the timer piston 96 can move perpendicularly to the axis of the cam ring 68. One end of the timer piston 96 defines a primary pressure chamber 100, and the other end of the piston 96 defines a secondary pressure chamber 102. The primary chamber 100 communicates with the outlet of the transfer pump 18 via a passage (not shown) provided with an orifice or restriction, so that the primary chamber 100 can be supplied with the pressure of fuel at the outlet of the transfer pump 18. The secondary chamber 102 generally communicates with the inlet of the transfer pump 18 via a passage (not shown), so that the secondary chamber 102 can be supplied with the pressure of fuel at the inlet of the transfer pump 18 which is normally lower than the pressure of fuel at the outlet thereof. A compression spring 104 disposed in the secondary chamber 102 is seated between the housing 10 and the timer piston 96 to urge the piston 96 toward the primary chamber 100. The displacement of the timer piston 96 depends on the difference in pressure between the primary and the secondary chambers 100 and 102. The timer piston 96 is coupled to the cam ring 68 via a connecting rod 106 so that the displacement of the timer piston 96 causes angular displacement of the cam ring 68 relative to the housing 10. Therefore, the timing of fuel injection depends on the difference in pressure between the primary and the secondary chambers 100 and 102.

The primary chamber 100 and the secondary chamber 102 are interconnected via a passage 108 defined in the walls of the housing 10. An ON-OFF electromagnetic or solenoid valve 110 attached to the housing 10 serves to block and open the interconnecting passage 108. As the solenoid valve 110 is electrically energized and deenergized, the valve 110 opens and blocks the passage 108 respectively. As the passage 108 is opened and blocked, the difference in pressure between the primary and secondary chambers 100 and 102 drops and rises respectively. If the solenoid valve 110 is electrically driven by a pulse signal with a relatively high frequency, the difference in pressure between the primary and the secondary chambers 100 and 102 is held at a essentially constant level which depends on the duty cycle of the driving pulse signal. As a result, the timing of fuel injection can be adjusted via control of the duty cycle of the driving pulse signal applied to the solenoid valve 110.

A fuel return connector 120 attached to the housing 10 defines a fuel return port communicating with the reservoir 20 and leading to the fuel tank. Fuel returns from the reservoir 20 to the fuel tank via the fuel return port. The resulting fuel flow through the reservoir 20 lubricates and cools the moving parts of the injection pump.

Figure 3:
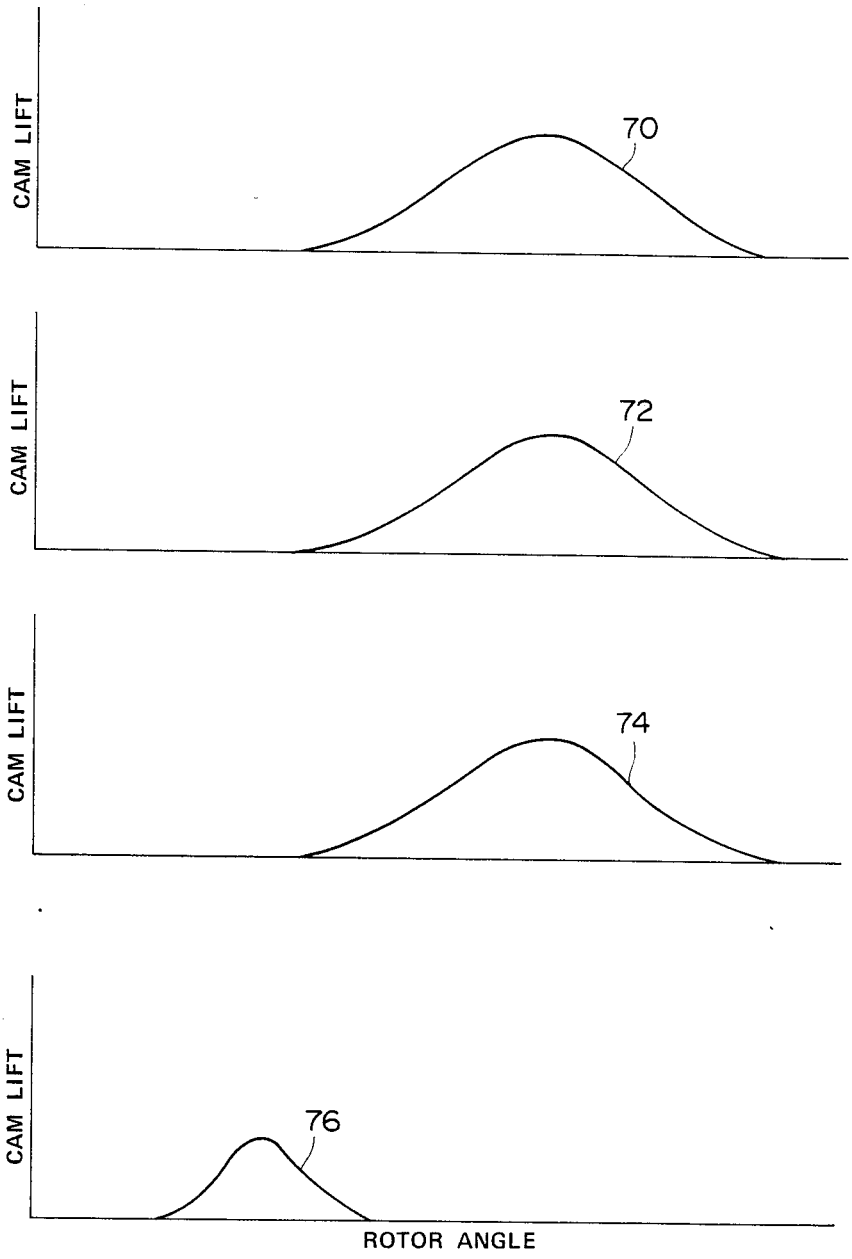
FIG. 3 is a diagram of profiles of the cam protrusions in the fuel injection pump of FIG. 1.

FIG. 3 diagramatically shows the profiles of the cam protrusions 70–76. In each of these diagrams, the ordinate is the radial position of the surface of the cam protrusion which determines the cam lift or displacement, and the abscissa is the rotational angle of the rotor 22 which corresponds to the cam angle. The origins of the abscissas of these four graphs are offset by angular intervals of 90°.

As shown in FIGS. 2 and 3, each of the cam protrusions 70–76 is in the form of a simple symmetrical knoll having a single peak. Since the shape of the cam protrusions 70–76 is a simple knoll, the rollers 60–66 can follow these cam protrusions 70–76 without any jumps which might occur in the case of cam protrusions of a complicated form, such as a shape with two narrowly separated peaks. The cam protrusions 70, 72, and 74 are identical, and their peaks are offset by angular intervals of exactly 90°. The cam protrusion 76 differs from the others. The peak of this unique cam protrusion 76 is lower than the others, as is the angular extent or dimension of this cam protrusion 76. In addition, the angular position of this cam protrusion 76 is offset toward the preceding cam protrusion 74 with respect to the direction of rotation of the rotor 22 as denoted by the arrow in FIG. 2. Specifically, the angular interval between the peaks of the cam protrusions 74 and 76 is a preset interval smaller than 90°. Thus, the angular interval between the peaks of the cam protrusions 70 and 76 is that preset interval larger than 90°. Accordingly, the timing of engagement between the unique cam protrusion 76 and the roller is in advance of the timing of engagement between the other cam protrusions and the rollers by that preset angular interval.

Each fuel injection stroke proceeds as follows: Since the unique cam protrusion 76 is in an advanced angular position, the opposing one of the rollers 60–66 encounters the cam protrusion 76 first and then the other rollers simultaneously encounter the other cam protrusions 70, 72, and 74. While the roller "ascends" the unique cam protrusion 76, the associated plunger moves radially inward and thereby contracts the pumping chamber 30, causing the initial stage of fuel injection stroke as denoted by the reference character P in FIG. 4. When the roller reaches the peak of the cam protrusion 76, the fuel injection caused by this cam protrusion 76 ends. Before the fuel injection caused by the unique cam protrusion 76 ends, the other rollers simultaneously encounter the other cam protrusions 70, 72, and 74. This is realized by a suitable arrangement of the unique cam protrusion 76 relative to the positions of the other cam protrusions 70, 72, and 74. While the rollers "ascend" these cam protrusions 70, 72, and 74, the associated plungers move radially inward and thereby contract the pumping chamber 30, causing the intermediate and final stage of fuel injection stroke as denoted by the reference character M in FIG. 4. When the rollers reach the peaks of the cam protrusions 70, 72, and 74, the overall fuel injection stroke ends.

Figure 4:
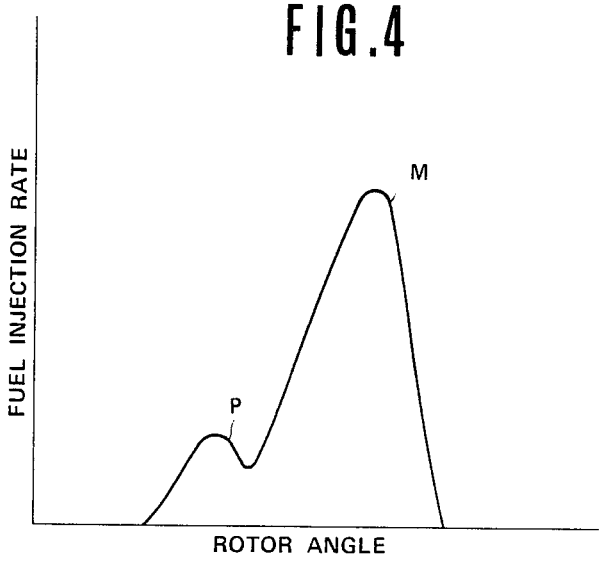
FIG. 4 is a diagram of the rate of fuel injection effected by the fuel injection pump of FIG. 1 with respect to the angular position of the rotor in the pump.

Since the unique cam protrusion 76 is lower than the others, the rate of fuel injection caused by this cam protrusion 76 is considerably smaller than the rate of fuel injection caused by the sum of the others. As shown in FIG. 4, the rate of fuel injection with respect to the rotational angle of the rotor 22 has two peaks, one in the initial injection stroke and the other in the main injection stroke respectively. The first peak caused by the unique cam protrusion 76 is considerably lower than the second peak caused by the other cam protrusions 70, 72, and 74. In this way, the rate of fuel injection during the initial stage of fuel injection stroke is held to a relatively low level so that fuel combustion pressure and temperature gradually rise. This gradual rise of the fuel combustion pressure and temperature results in reduction of combustion shocks, engine vibrations and noise, and harmful engine emissions.

In conventional fuel injection arrangements, fuel delivery valves are disposed in fuel delivery passages connecting the fuel injection pump and the fuel injection valves. In the embodiment of this invention, the fuel delivery ports 36 directly lead to the associated fuel injection valves so that there is no fuel delivery valve which would offer resistance to fuel flow to the injection valves and would thus provide a loss of pressure of fuel to the injection valves.

As an alternative, two or more cam protrusions may be in an angularly advanced arrangement with respect to the others.

In order to obtain complicated fuel injection rate curves, such as those involving pilot injection, the cam protrusions 70–76 may differ from each other in radial dimension, angular extent, and angular position, while still adhering to the shape of a simple knoll with a single peak.

In the case of application to an engine having six or more combustion chambers, the number of cam protrusions and that of plungers are naturally increased to equal the number of fuel injection valves for the respective combustion chambers.

This invention can also be applied to distribution-type fuel injection pumps of other arrangements in which plungers inside a cam ring rotate synchronously with respect to rotation of the engine crankshaft and a control sleeve adjustably determines the timing of relief of the pressurized fuel.

What is claimed is:

1. A fuel injection pump for an internal combustion engine provided with a fuel injection valve, comprising:

(a) a rotary distributor rotating in synchronism with engine revolution;

(b) a cam ring encircling the rotary distributor and having an inner surface formed with two or more cam protrusions; and (c) two or more plungers equal in number to the cam protrusions and mounted on the rotary distributor for rotation in accordance with rotation of the rotary distributor, the plungers defining a common pumping chamber and engaging the inner surface of the cam ring for reciprocation in the radial direction with respect to the rotary distributor to pump fuel out of said common pumping chamber into the injection valve;

at least one of the cam protrusions having a cam lift profile different from those of the other cam protrusions so that the sum of the cam lift profiles of the cam protrusions determining fuel injection rate differs in shape from each of the cam lift characteristics, wherein:

said plungers are arranged radially, said cam protrusions are arranged around said cam ring, and said difference in cam lift profile includes a slight uneven angular offset of one of said cam protrusions with respect to the other cam protrusions; and said offset cam protrusion engages one of said plungers before the other cam protrusions engage the other plungers, and said offset cam protrusion has less angular extent that said other cam protrusions.

2. The fuel injection pump of claim 1, wherein each of said cam protrusions has a single peak and the timings of engagement between each set of plunger and cam protrusion are so offset that the trace of the volume of said common pumping chamber with respect to the relative angular position of said plungers and said cam ring has two peaks.

3. The fuel injection pump of claim 1, wherein said offset cam protrusion has less radial extent than said other cam protrusions.

4. A fuel injection pump for an internal combustion engine provided with a fuel injection valve, comprising:

(a) a rotary distributor rotating in synchronism with engine revolution;

(b) a cam ring encircling the rotary distributor and having an inner surface formed with two or more cam protrusions; and (c) two or more plungers equal in number to the cam protrusions and mounted on the rotary distributor for rotation in accordance with rotation of the rotary distributor, the plungers defining a common pumping chamber and engaging the inner surface of the cam ring for reciprocation in the radial direction with respect to the rotary distributor to pump fuel out of said common pumping chamber into the injection valve;

at least one of the cam protrusions having a cam lift profile different from those of the other cam protrusions so that the sum of the cam lift profiles of the cam protrusions determining fuel injection rate differs in shape from each of the cam lift characteristics, wherein:

said plungers are arranged radially, said cam protrusions are arranged around said cam ring, and said difference in cam lift profile includes a slight uneven angular offset of one of said cam protrusions with respect to the other cam protrusions; and said offset cam protrusion engages one of said plungers before the other cam protrusions engage the other plungers, said inner surface of the cam ring defines an outermost base circle, and said offset cam protrusion has a radial dimension with respect to the base circle less than the corresponding radial dimensions of said other cam protrusions.

5. The fuel injection pump of claim 4, wherein said offset cam protrusion has less angular extent than said other cam protrusions.

6. A fuel injection pump for an internal combustion engine having a rotatable crankshaft and a combustion chamber, the injection pump comprising:

(a) a cam ring with an internal surface having inwardly projecting lobes defining first and second cam protrusions;

(b) a rotary distributor (c) first and second movable plungers arranged in said rotary distributor defining a common pumping chamber, the volume of which varies in accordance with the position of each of the plungers, the first and second plungers alternately engaging with the first and second cam protrusions and thereby reciprocating the first and second plungers in synchronism with rotation of the crankshaft;

(d) means for supplying fuel to the pumping chamber as the pumping chamber expands;

(e) means for directing the fuel out of the pumping chamber toward the combustion chamber as the pumping chamber contracts; and (f) means for offsetting the timing of engagement of one of the plungers with one of the cam protrusions and the timing of engagement of the other plunger with the other cam protrusion by a preset angular interval with respect to rotation of the crankshaft, wherein the preset angular interval is chosen so that the fuel supplied to the combustion chamber by engagement of one of the plungers with one of the cam protrusions is continuous with fuel supplied to the combustion chamber by engagement of the other plunger with the other cam protrusion;

the fuel supplied to the combustion chamber by engagement of the first cam protrusion with one of the first and second plungers is always in advance of fuel supplied to the combustion chamber by engagement of the second cam protrusion with the other plunger in each combined continuous fuel supply stroke; and the first cam protrusion is angularly smaller than the second cam protrusion so that said first cam protrusion engages said movable plungers more briefly than said second cam protrusion engages said movable plungers.

7. The fuel injection pump of claim 6, wherein the first cam protrusion is smaller than the second cam protrusion in dimension effective to displace the first and second plungers.

* * * * *